US007735303B2

(12) United States Patent
Hoffman

(10) Patent No.: US 7,735,303 B2
(45) Date of Patent: Jun. 15, 2010

(54) METHOD AND APPARATUS FOR FILLING TUNA CANS WITH CONSISTENT PREMIUM TUNA CAKE APPEARANCE

(75) Inventor: Michael Allen Hoffman, Pueblo West, CO (US)

(73) Assignee: Atlas Pacific Engineering Company, Pueblo, CO (US)

( * ) Notice: Subject to any disclaimer, the term of this patent is extended or adjusted under 35 U.S.C. 154(b) by 156 days.

(21) Appl. No.: 12/074,652

(22) Filed: Mar. 5, 2008

(65) Prior Publication Data

US 2009/0061036 A1 Mar. 5, 2009

Related U.S. Application Data

(60) Provisional application No. 60/905,756, filed on Mar. 8, 2007.

(51) Int. Cl.
*B25B 25/06* (2006.01)

(52) U.S. Cl. ..... 53/517; 53/435; 53/436; 53/438; 53/439; 53/523; 53/514; 53/513; 53/250; 53/253; 53/254

(58) Field of Classification Search ..... 53/428, 53/435, 436, 438, 439, 467, 473, 513–514, 53/517, 523, 249–254
See application file for complete search history.

(56) References Cited

U.S. PATENT DOCUMENTS

| | | | | | |
|---|---|---|---|---|---|
| 3,230,579 | A | * | 1/1966 | Johnston | 425/574 |
| 3,864,891 | A | * | 2/1975 | Piereder | 53/436 |
| 4,116,600 | A | * | 9/1978 | Dutton et al. | 425/296 |
| 4,166,140 | A | * | 8/1979 | Dutton et al. | 426/397 |
| 4,237,581 | A | * | 12/1980 | Langen et al. | 100/37 |
| 4,483,046 | A | * | 11/1984 | Briddell | 425/556 |
| 5,887,413 | A | * | 3/1999 | Rowley et al. | 53/517 |

* cited by examiner

*Primary Examiner*—Christopher Harmon
(74) *Attorney, Agent, or Firm*—Bruce H. Johnsonburgh

(57) ABSTRACT

A tuna fish canning apparatus is provided wherein each can has a premium cake appearance. The machine has first and second turrets adjacent each other which rotate around a common axis. Fish slugs loaded into a shared pocket by the adjacent turrets are severed along a plane between the turrets to produce first and second cakes with each cake having a cut surface and each cake adapted to be transferred into a can. The present invention provides first and second knock-out plungers for ejecting the first and second cakes into cans, wherein the first and second knock-out plungers are positioned on opposite sides of the plane between the first and second turrets so that each cake has its freshly cut surface at the top of the can to provide a premium appearance. A method for achieving the same result is also disclosed.

2 Claims, 9 Drawing Sheets

METHOD AND APPARATUS FOR FILLING TUNA CANS WITH CONSISTENT PREMIUM TUNA CAKE APPEARANCE

CROSS-REFERENCE TO RELATED APPLICATION

This application claims the benefit of and priority from U.S. provisional application Ser. No. 60/905,756 filed Mar. 8, 2007.

BACKGROUND AND BRIEF SUMMARY OF INVENTION

The present invention pertains to machines for filling cans with solid pack tuna. More particularly, the present invention provides a significant improvement to a widely used, prior art tuna canning machine known today as the "Luthi SP" canning machine. The "Luthi SP" machine is currently manufactured by the assignee of this application, Atlas Pacific Engineering Company, and is shown and described in U.S. Pat. No. 4,116,600, incorporated herein by reference.

The Luthi SP machine is capable of filling two cans simultaneously. An inherent disadvantage to that machine is that, without the benefit of the present invention, only one-half of the filled cans have the freshly cut cake surface at the top of the can. The other one-half of the filled cans have the freshly cut cake surface at the bottom of the can. The disadvantage of having the freshly cut cake surface at the bottom of half the cans is that those cans are downgraded, as described below, at significant cost to the canner. The present invention, as described below, overcomes the problem and achieves the result of every filled can having the freshly cut cake surface at the top of the can.

The perceived quality of the canned tuna is based primarily on what the customer sees at the top of the can when it is opened. As noted in the '600 patent, referenced above, the best quality of solid pack tuna is when the fish is packed with the grain being vertical, and with minimum amount of fragments and floating particles at the top of the can. It has been known that the premium tuna cake appearance is achieved at the "cut cake surface," referring to that surface created by a knife which cuts a "plug" into two, can sized "cakes." However, until the present invention, it has not been realized how to achieve a "cut cake surface" at the top of every can. The need for consistent premium cake appearance has existed since at least 1978, the date of the '600 patent. Certain markets for canned tuna today demand a consistent premium cake appearance. The applicant is unaware of any solution, other than the present invention, to the problem of presenting a "cut cake surface" at the top of every can of solid pack tuna wherein at least two cans are filled simultaneously by a single machine.

The solution provided by the present invention is elegant in its simplicity. Whereas the prior art would slice a tuna plug into two can sized cakes along a planar surface A-A, and then transfer both cakes with two knock-out plungers positioned on the same side of planar surface A-A into two cans positioned on the opposite side of planar surface A-A, the present invention transfers the cakes into two cans positioned on opposite sides of planar surface A-A with knock-out plungers each located on opposite sides of planar surface A-A. This solution has escaped those skilled in the art since at least 1978, some 30 years!! In addition to solving the above stated problem, the present invention may be relatively easily retrofitted onto pre-existing Luthi SP machines! Indeed, as shown and described below, the present invention is described as applied to Luthi SP machines, but is applicable to similarly designed tuna packing machines available from other suppliers.

A primary object of the present invention is to provide an apparatus and method for canning solid pack tuna wherein a premium cake appearance is achieved in every can.

A further object of the invention is to provide an apparatus that may be readily retrofitted onto existing, prior art tuna canning machines to provide a premium cake appearance in every can rather than in only half the cans.

Other objects and advantages will become apparent from the following description and the drawings.

DETAILED DESCRIPTION OF THE DRAWINGS

Figure 1:
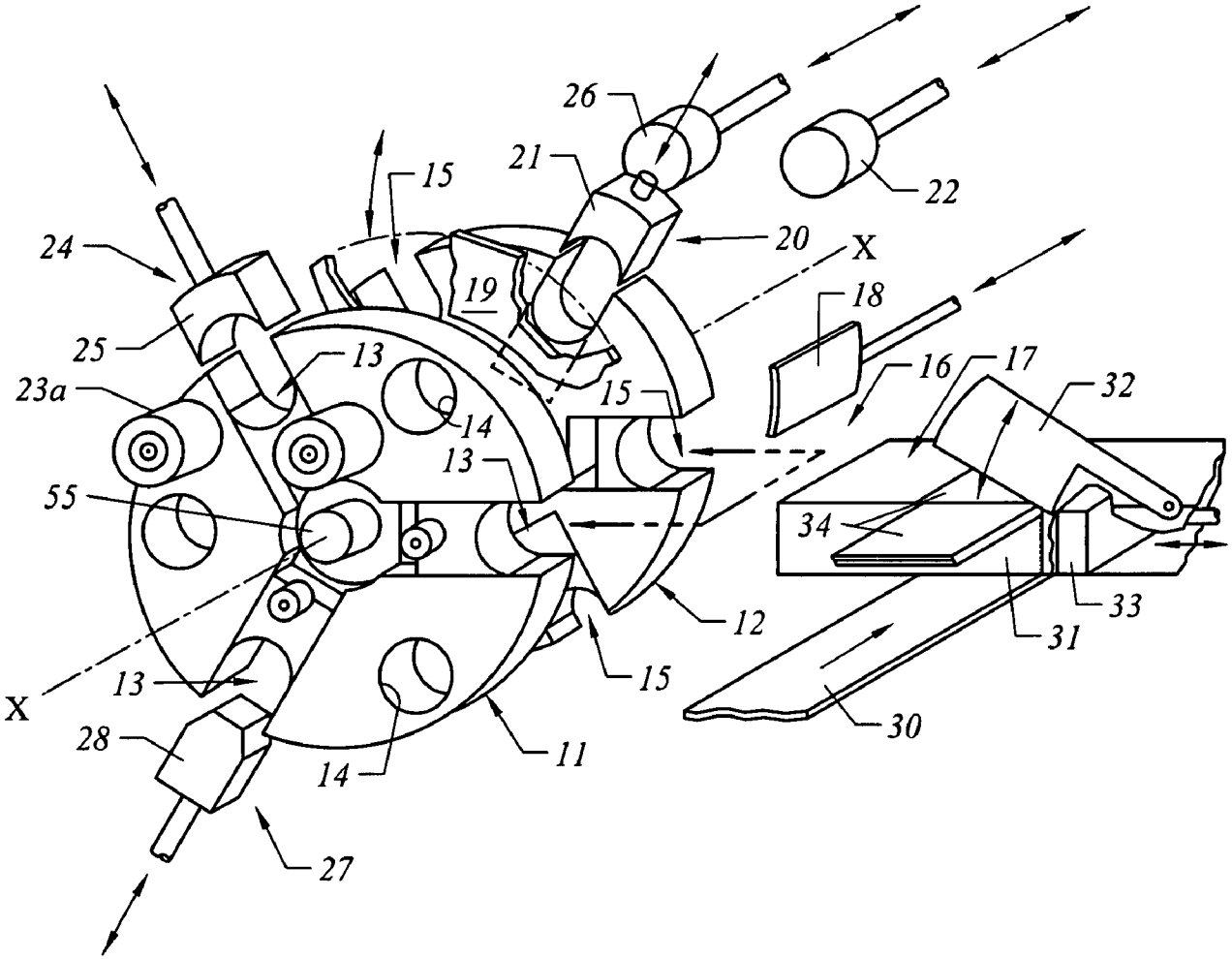
FIG. 1 (Prior Art)
FIG. 1 is a perspective view of the key operating parts of the Luthi SP machine, and is reproduced from U.S. Pat. No. 4,116,600.

FIG. 1 is reproduced from prior art U.S. Pat. No. 4,116,600 (with minor changes to lead lines and reference numbers) and illustrates the existing Luthi SP machine. The following description of FIG. 1 is reproduced (with minor exception) from the '600 patent for reference. The machine comprises a pair of rotatable turrets 11 and 12 mounted for rotation about a common axis X-X. Turret 11 has three fish-receiving pockets 13 spaced equidistantly therearound and openings 14 between each pair of adjacent pockets. Turret 12 has six equidistantly spaced fish-receiving pockets 15 around the periphery thereof. When the turrets are positioned as in FIG. 1, every other pocket 15 of turret 12 is in axial alignment with a pocket 13 of turret 11 and each of the other pockets 15 of turret 12 is in axial alignment with one of the openings 14 through turret 11.

Three operating stations are spaced around the periphery of the turrets. The first or feed station 16 comprises the feed chute 17 and a reciprocating volume knife 18 which moves between the end of the feed chute 17 and the peripheries of turrets 11, 12. A pivotal divider knife 19 is mounted on an axis parallel to that of the turrets for in-and-out movement between the turrets to sever fish that have been fed into the pockets at station 16.

A second operating station 20 comprises a former plunger 21 mounted for reciprocatory movement radially of turret 12 into and out of a pocket 15 of turret 12, and a knock-out plunger 22 mounted for reciprocatory movement along a line parallel to the turret axis and adapted to move axially into and through a pocket 15 of turret 12 and the aligned opening 14 of turret 11 to eject fish into a can 23*b* and then move out of the opening 14 and pocket 15.

The third station 24 is similar to the second station and includes a former plunger 25 of turret 11 and a knock-out plunger 26 adapted to move through aligned pockets of the turrets to eject fish from a pocket of turret 11 into another can 23*a*.

If desired, a fourth operating station 27 may be provided, this station comprising a lock plunger 28 movable radially of the turrets into and out of aligned pockets of the turrets thereat for locking the turrets against rotation. This station is necessary only if the indexing drive for the turrets does not itself provide sufficient locking of the turrets in the dwell period between rotation of the turrets from the first station to the second and third stations.

The apparatus further includes a conveyor belt 30 which delivers fish loins to the feed chute 17, the loins entering the chute through the side opening 31 thereof. A loin knife 32 is positioned to move down across the side opening 31 and sever the loins fed into the chute, the loins then being moved down the chute towards the turrets by ram 33. A vertically movable tamper 34 facilitates entry of fish loins into the feed chute.

In addition to the above description from the '600 patent, it is important to note that knife 19 shown in FIG. 1 moves in a plane normal to axis X-X and is positioned between adjacent turrets 11 and 12. It is significant to note that the cans 23*a* and 23*b* which are being filled with tuna are both located on the same side of the plane between turrets 11 and 12 and the knock-out plungers 22 and 26 are both located on the opposite side of that plane.

Figure 2A:
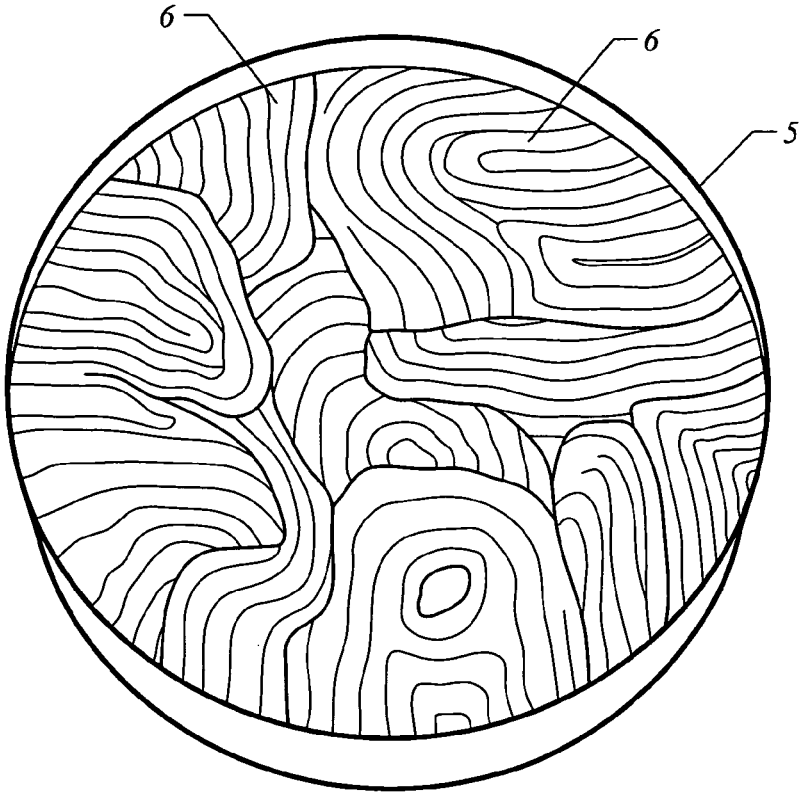
FIGS. 2A and 2B are schematic illustrations of a filled tuna can in FIG. 2A having a premium cake appearance and a filled tuna can in FIG. 2B having a downgraded appearance.
Figure 2B:
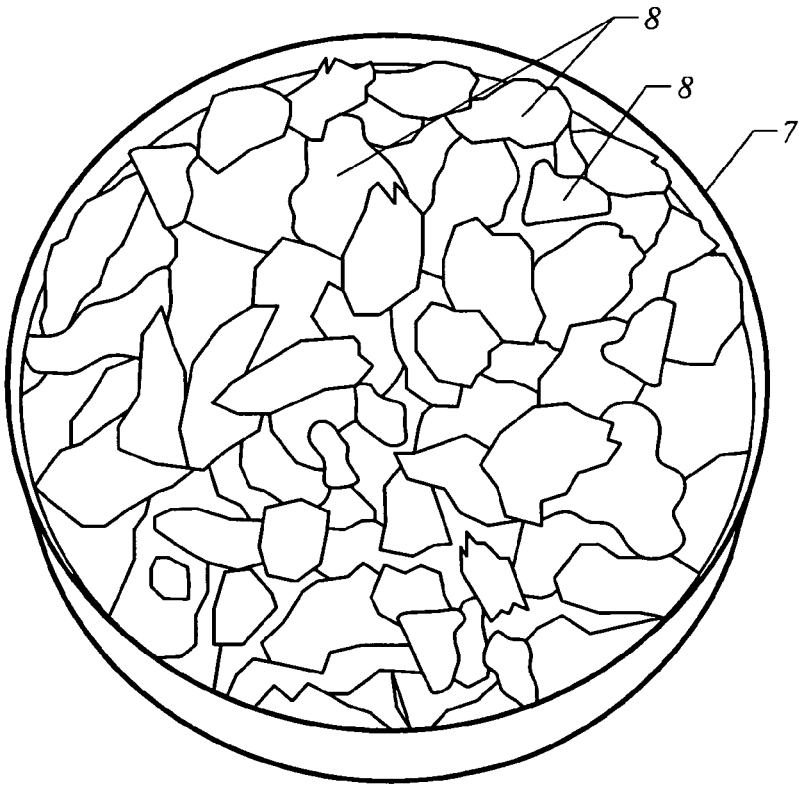

FIGS. 2A and 2B are schematic illustrations which show the difference between premium cake appearance as shown in FIG. 2A and downgraded cake appearance as shown in FIG. 2B. As shown in FIG. 2A, can 5 has had its top removed and the tuna loins 6 are packed with the grain being vertical and wherein the chunks have minimal amount of fragments and floating particles. The premium cake appearance shown in FIG. 2A is achieved in part because what is being observed is the cut cake surface at the top of can 5 which had been cut by divider knife 19 shown in FIG. 1.

In contrast, as shown in FIG. 2B, can 7 exhibits a downgraded cake appearance wherein the appearance of the tuna 8 at the top of can 7 includes numerous small particles, as noted above. The primary cause of this downgraded appearance shown in FIG. 2B is that the cake transferred into can 7 shown in FIG. 2B has the freshly cut surface placed at the bottom of the can, rather than at the top of the can.

FIGS. 3A-3D are schematic illustrations which show the "concept" of operation of the prior art Luthi SP machine shown in U.S. Pat. No. 4,116,600 and FIG. 1 above.

Figure 3A:
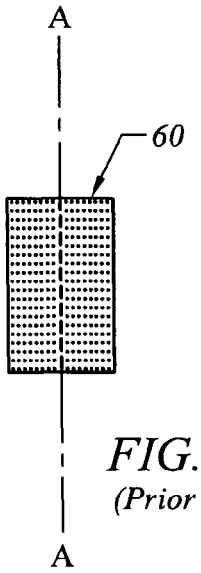
FIG. 3A (Prior Art)
FIGS. 3A-3D are schematic representations illustrating the "concept" of how the prior art Luthi SP machine shown in FIG. 1 operates.

FIG. 3A shows conceptually a plug 60 of solid pack tuna that has just been loaded partially into pocket 15 of turret 12 and partially into pocket 13 of turret 11 (not shown in FIG. 3A for clarity) and prior to the "plug" 60 being severed along planar surface A-A between turrets 11 and 12 by divider knife 19.

Figure 3B:
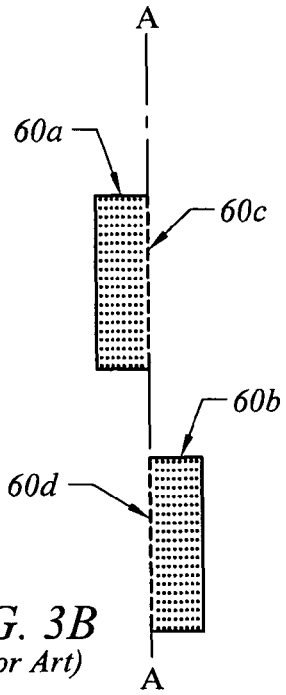
FIG. 3B (Prior Art)

FIG. 3B illustrates the second step wherein the divider knife 19 (not shown) has severed plug 60 of FIG. 3A into cut cakes 60*a* and 60*b* (each of which will be transferred into a single can) and after cakes 60*a* and 60*b* have been displaced from each other by relative rotation of turrets 11 and 12. It is significant to note that cut cake 60*a* has a cut surface 60*c* and cake 60*b* has a cut surface 60*d*. Cut cake surfaces 60*c* and 60*d* each have the premium cake appearance illustrated in FIG. 2A above.

Figure 3C:
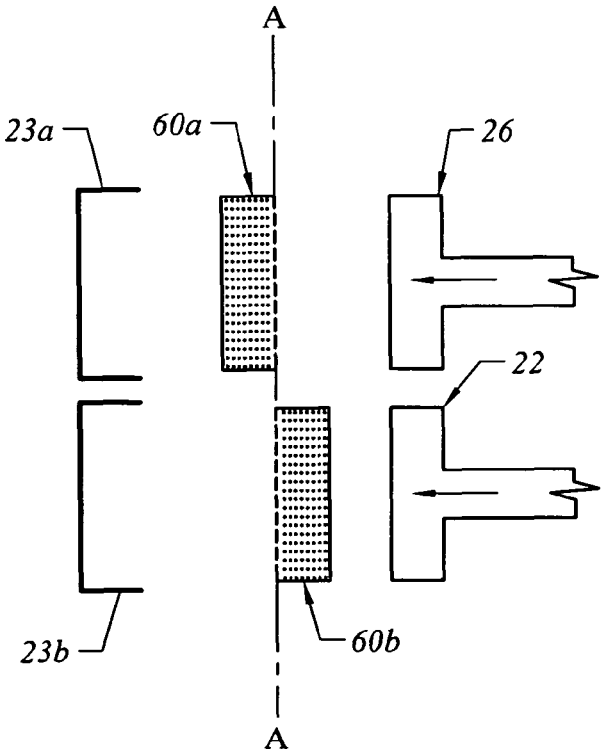
FIG. 3C (Prior Art)
Figure 3D:
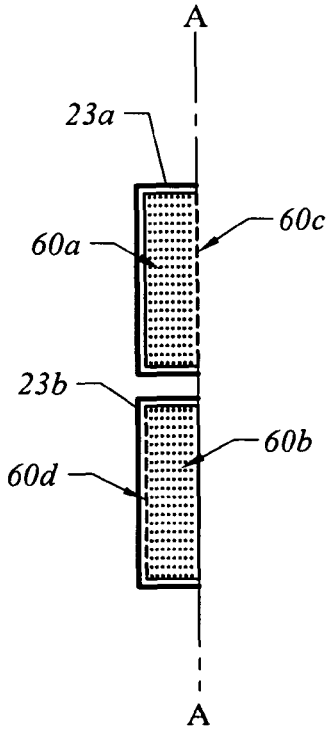
FIG. 3D (Prior Art)

FIG. 3C illustrates conceptually how cut cakes 60*a* and 60*b* are transferred into cans 23*a* and 23*b*, respectively. Knock-out plungers 26 and 22 are driven into cakes 60*a* and 60*b* from the same side of planar surface A-A and transfer cakes 60*a* and 60*b* into cans 23*a* and 23*b*, which cans are both on the opposite side of plane A-A from knock-out plungers 26 and 22. As shown in FIG. 3D, cake 60*a* has been transferred into can 23*a* with the premium cake surface 60*c* at the top of can 23*a*. However, cake 60*b* has been transferred into can 23*b* with the premium cake surface 60*d* at the bottom of the can. Therefore, can 23*b* will have a downgraded appearance at the surface of the can, which results in a significant cost to the canner.

FIGS. 4A-4D illustrate conceptually the operation of the present invention.

Figure 4A:
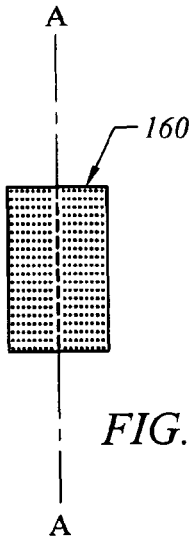
FIGS. 4A-4D are schematic illustrations that show the "concept" of operation of the Luthi SP canning machine as modified by the present invention.

FIG. 4A illustrates plug 160 prior to plug 160 being severed by a divider knife (not shown) that moves in the plane A-A between turrets 11 and 12 (not shown in FIG. 4A).

Figure 4B:
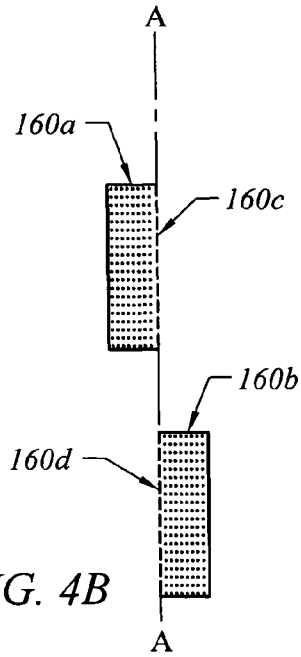

FIG. 4B illustrates cakes 160*a* and 160*b* after plug 160 has been cut by divider knife 32 (not shown).

Figure 4C:
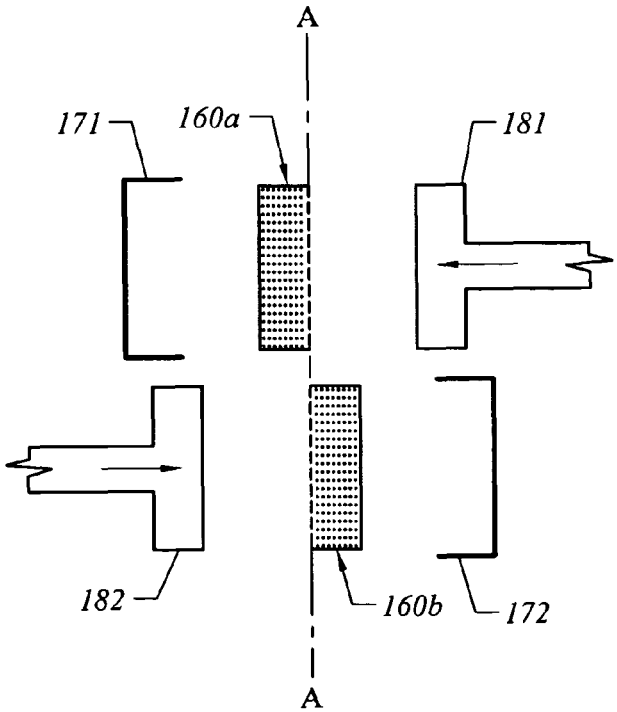

FIG. 4C illustrates in simple fashion the difference between the present invention and the prior art knock-out plungers shown in FIG. 3C. In FIG. 4C, knock-out plunger 181 is positioned on the righthand side of plane A-A and knock-out plunger 182 is positioned on the lefthand side or the opposite side of planar surface A-A. In this fashion, both knock-out plungers 181 and 182 are on opposite sides of planar surface A-A, and move to contact the cut surfaces 160*c* and 160*d* of the two cakes 160*a* and 160*b* and transfer those cakes into cans 171 and 172. Cans 171 and 172 are positioned on opposite sides of planar surface A-A from each other, in contrast to the prior art.

Figure 4D:
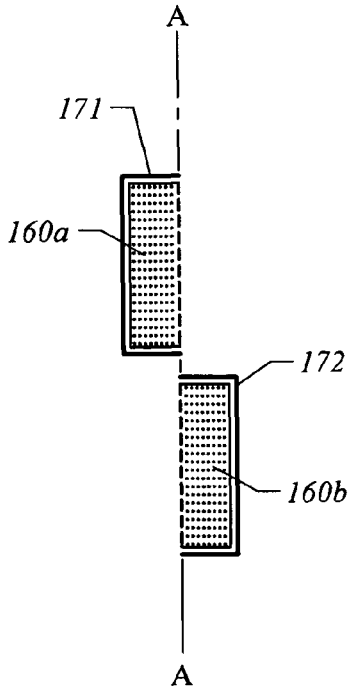

As shown in FIG. 4D, cakes 160*a* and 160*b* when transferred into cans 171 and 172 have their cut surfaces 160*c* and 160*d*, respectively, at the top of cans 171 and 172. Both cans 171 and 172 exhibit the desired premium cake appearance.

Figure 5:
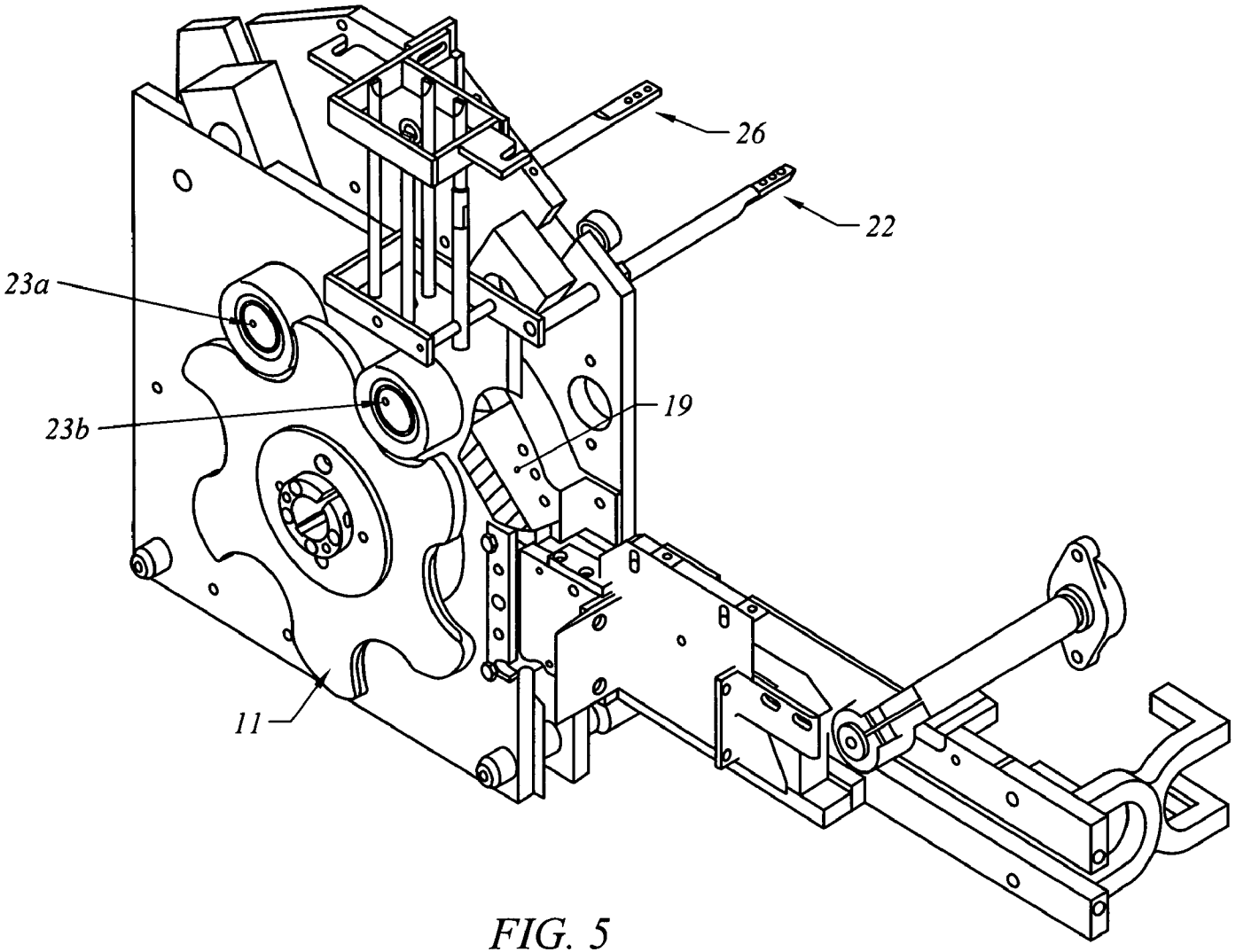
FIG. 5 (Prior Art)
FIG. 5 is a perspective view of the prior art Luthi SP machine showing the relative positioning of the knock-out plungers relative to the two cans being filled.

FIG. 5 is a perspective view, partially broken away, of a portion of the Luthi SP prior art machine. Turret 11 is visible in FIG. 5 along with cans 23*a* and 23*b*. Cans 23*a* and 23*b* in FIG. 5 are on the lefthand side of the plane in which the divider knife 19 moves as noted above. Knock-out plungers 26 and 22 are visible in part in FIG. 5 and both of those plungers are on the opposite side of the central plane A-A from cans 23*a* and 23*b*, as described above.

Figure 6:
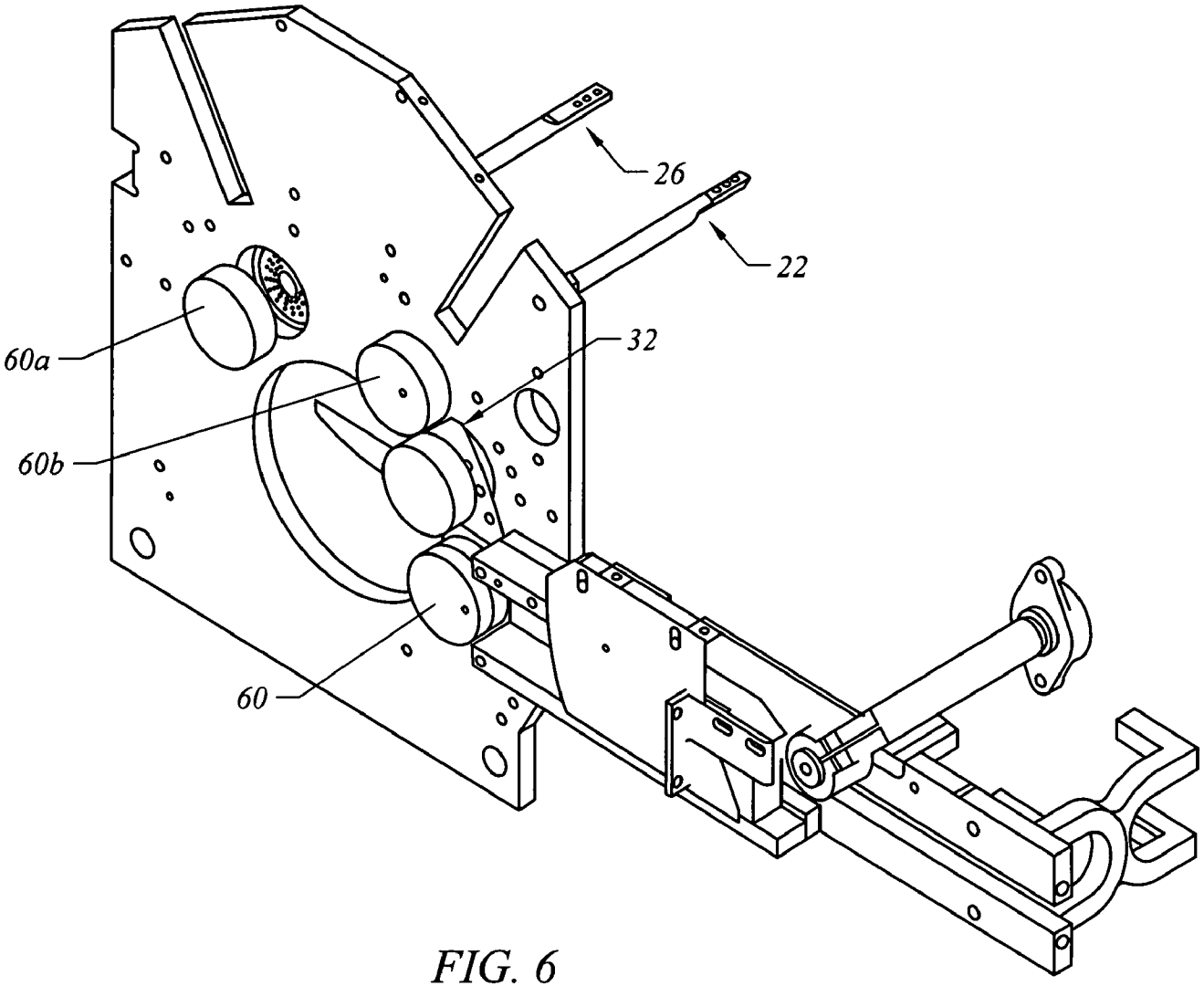
FIG. 6 (Prior Art)
FIG. 6 is a perspective view of the machine shown in FIG. 5 wherein portions of the machine are deleted to illustrate the cut tuna cakes as they are about to be transferred into their respective cans.

FIG. 6 is a perspective view of the same machine shown in FIG. 5 wherein portions of the machine have been deleted to illustrate the positions of the tuna fish slug 60 before it is sliced by divider knife 19 into a first cake 60*a* and a second cake 60*b*. Knock-out plungers 26 and 22 are again visible. As shown in the concept drawings 3A-3D, cake 60*a* will have its cut surface at the top of can 23*a* (not shown in FIG. 6) and cake 60*b* will have its cut surface transferred into the bottom of can 23*b* (not shown in FIG. 6).

Figure 7:
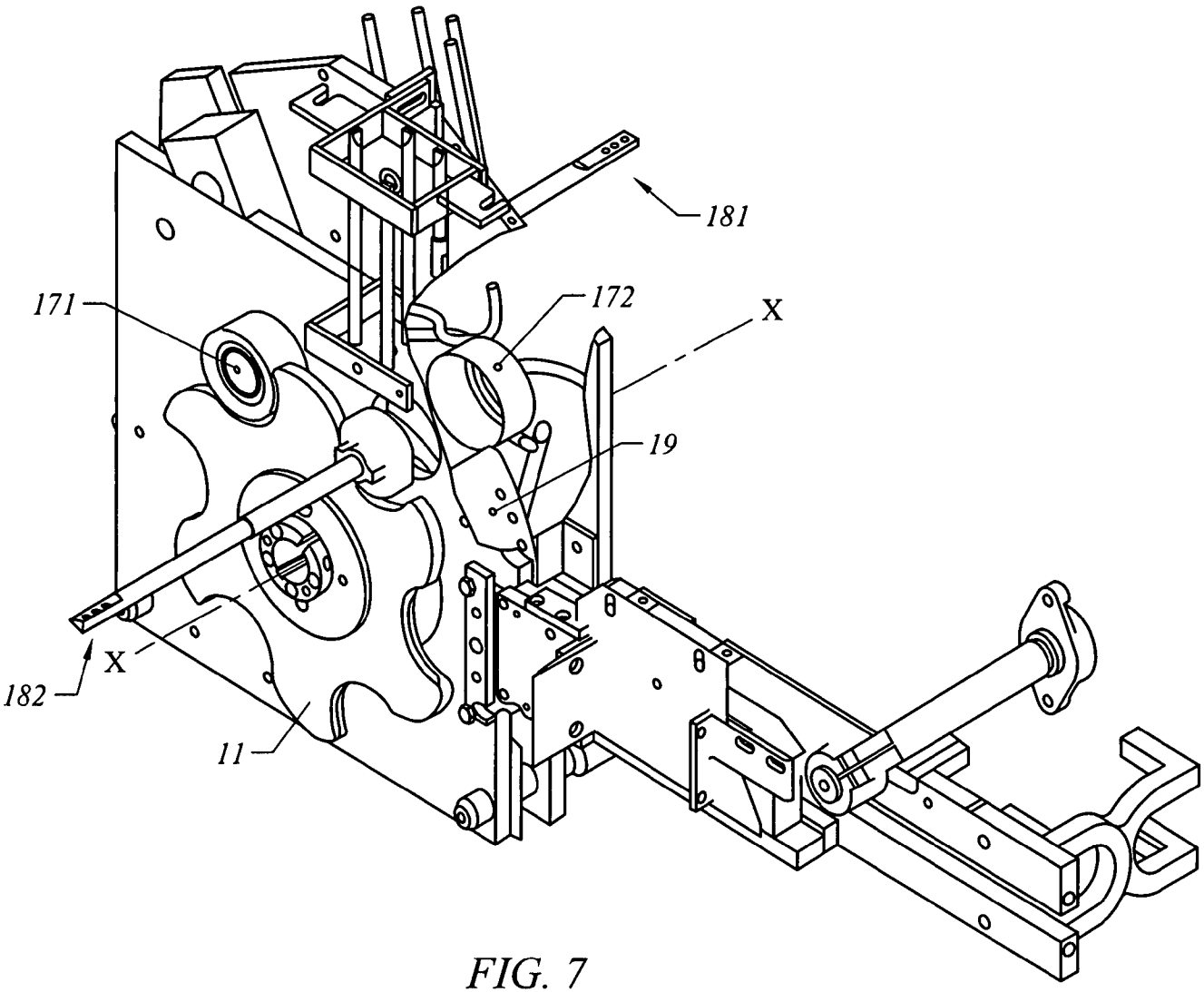
FIG. 7 is a perspective view of the Luthi SP machine as modified by the present invention, illustrating how the knock-out plungers are positioned on opposite sides of the central plane positioned between turrets 11 and 12 of the machine.

FIG. 7 illustrates the Luthi SP machine as modified to practice the present invention. Turret 11 is visible. Divider knife 19 is shown in its position moving in the plane between turrets 11 and 12, as described above. A first knock-out plunger 181 is shown in FIG. 7 on the opposite side of the plane between turrets 11 and 12 from the second knock-out plunger 182. Similarly, can 171 and can 172 are shown on opposite sides of the central plane (A-A in FIG. 4C) between turrets 11 and 12.

Figure 8:
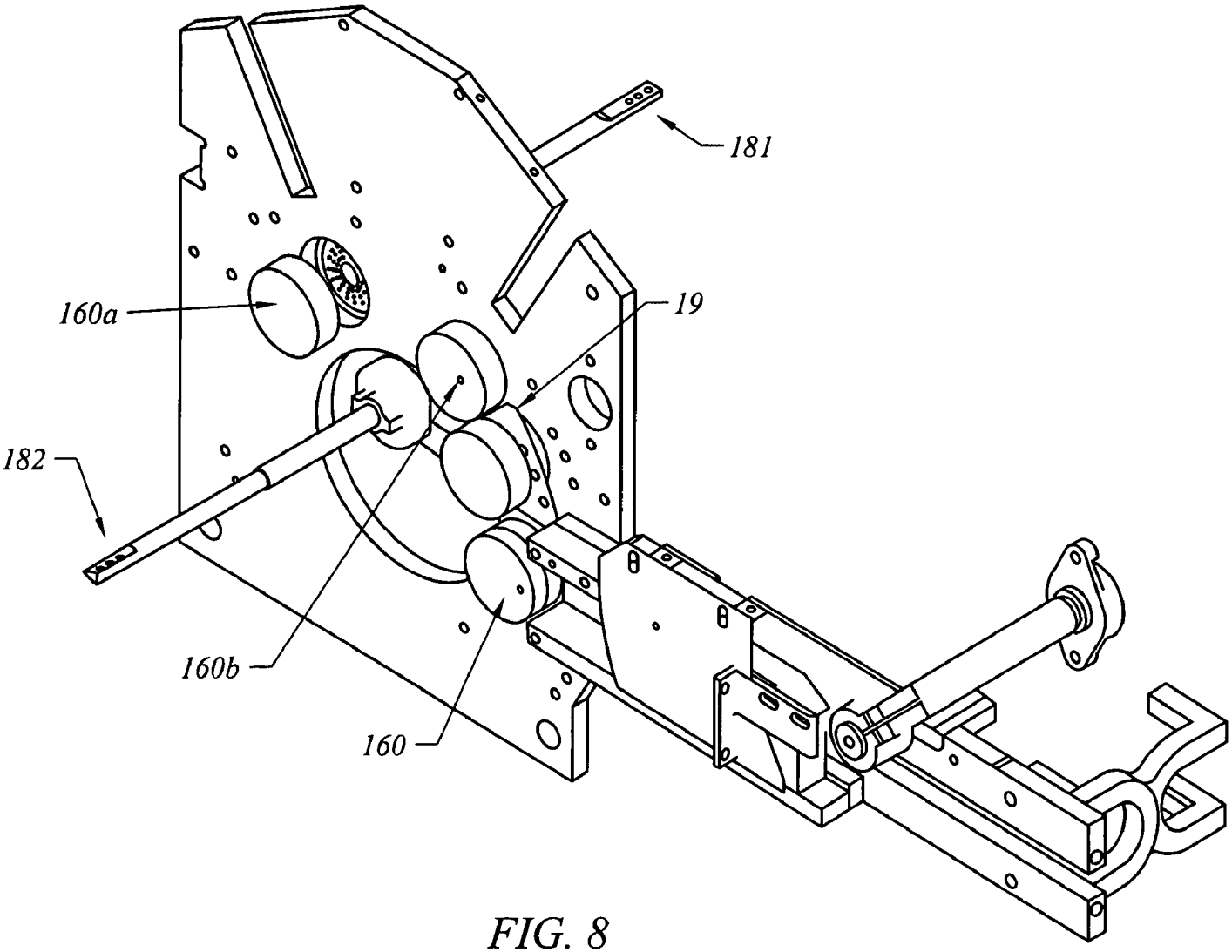
FIG. 8 is a perspective view of the same machine shown in FIG. 7 with components of the machine deleted to illustrate the positioning of the cut tuna cakes and the relative positioning of the knock-out plungers located on opposite sides of the central plane of the machine.

FIG. 8 illustrates that portion of the modified Luthi SP machine shown in FIG. 7 with further parts deleted to show the critical positions of the tuna being processed by the machine. A metered fish slug 160 is shown before it is severed into two cakes by divider knife 19. Cut cakes 160*a* and 160*b* are illustrated after they have been cut by divider knife 19. As described above, knock-out plunger 181, as shown in FIG. 8, moves from the righthand side of FIG. 8 toward the lefthand side of FIG. 8 to transfer cake 160*a* into can 171 (not shown in FIG. 8). As shown in FIG. 8, knock-out plunger 182 moves from the left toward the right to transfer cake 160*b* into can 172 (not shown in FIG. 8). As noted above, knock-out plungers 181 and 182 are on opposite sides of the central plane between turrets 11 and 12, which is also the plane in which divider knife 19 moves.

Figure 9:
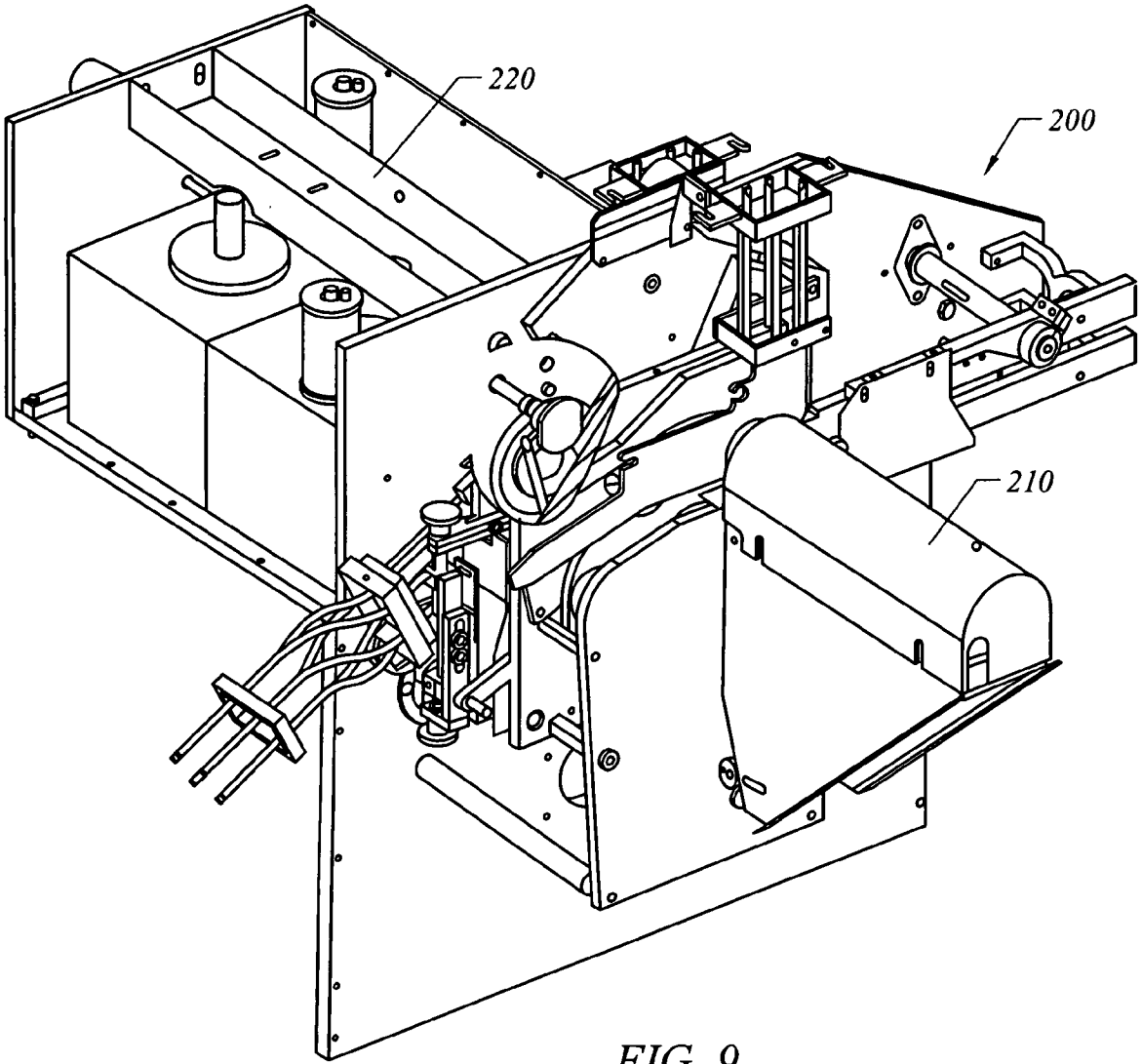
FIG. 9 is a perspective view of the modified Luthi SP machine which has been retrofitted with the present invention which illustrates the housings for the modified plunger or transfer mechanisms.

FIG. 9 is a perspective view of the Luthi SP machine 200 as retrofitted by the present invention. The two knock-out plungers located on opposite sides of the central plane of the machine are located in housing 210 and housing 220.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. Apparatus for canning premium solid pack tuna fish comprising:

first and second turrets adjacent each other and rotating around a common axis, wherein each turret has a plurality of aligned fish receiving pockets for receiving slugs of solid pack tuna fish, a pivotal divider knife for severing said slugs along a plane normal to said axis of rotation and between said first and second turrets whereby each slug is freshly cut into first and second cakes, each cake having a freshly cut surface and each cake adapted to be transferred into a can, first and second cans positioned on opposite sides of said plane, and first and second knock-out plungers for ejecting said first and second cakes into said first and second cans, wherein said first and second knock-out plungers are positioned on opposite sides of said plane between said first and second turrets and wherein each of said knock-out plungers moves in an opposite direction with respect to each other, but wherein each of said plungers moves perpendicularly to said plane and contacts said freshly cut surface of each cake to eject each cake into a can, whereby each cake ejected into a can has said freshly cut surface at the top of said can.

2. A method of canning fish wherein first and second turrets are positioned adjacent each other and rotate around a common axis, wherein each turret has a plurality of aligned fish receiving pockets for receiving slugs of solid pack tuna fish, characterized by the following steps:

severing said slugs along a plane normal to said axis of rotation and between said first and second turrets whereby each slug is freshly cut into first and second cakes, each cake having a freshly cut surface and each cake being adapted to be transferred into a single can, positioning first and second knock-out plungers on opposite sides of said plane between said first and second turrets, positioning first and second cans on opposite sides of said plane, contacting said cut surface of said first and second cakes with said first and second knock-out plungers, respectively, by moving each of said plungers in opposite directions perpendicular to said plane and ejecting each of said first and second cakes into said first and second cans with said freshly cut surface of each cake at the top of each can.

* * * * *